US006502289B1

(12) United States Patent
Kane et al.

(10) Patent No.: US 6,502,289 B1
(45) Date of Patent: Jan. 7, 2003

(54) COMPOSITE NONWOVEN FABRIC AND METHOD FOR MAKING SAME

(75) Inventors: Terrence P. Kane, Morton Grove; Kurt H. Schild, III, Wadsworth, both of IL (US)

(73) Assignee: Global Material Technologies, Inc., Palatine, IL (US)

( * ) Notice: Subject to any disclaimer, the term of this patent is extended or adjusted under 35 U.S.C. 154(b) by 0 days.

(21) Appl. No.: 09/366,895

(22) Filed: Aug. 4, 1999

(51) Int. Cl.[7] ..... D04H 1/42; D04H 1/46

(52) U.S. Cl. ..... 28/107; 28/103

(58) Field of Search ..... 28/107, 109, 110, 28/111, 112, 114, 101, 102, 103, 104; 442/415, 377, 388, 403, 406; 156/148

(56) References Cited

U.S. PATENT DOCUMENTS 3,338,777 A * 8/1967 Irwon et al. ..... 28/107
3,836,422 A * 9/1974 Bischoff ..... 28/72.2 R
RE28,470 E * 7/1975 Webber ..... 29/180 R
3,975,565 A * 8/1976 Kendall ..... 28/72.2 R
4,284,680 A * 8/1981 Awano et al. ..... 28/107
4,707,895 A * 11/1987 Lang ..... 28/107
4,847,140 A * 7/1989 Jaskowski ..... 28/112
4,851,274 A * 7/1989 D'Elia ..... 28/112
5,380,580 A * 1/1995 Rogers et al. ..... 28/104
5,475,904 A * 12/1995 Le Roy ..... 28/108
5,972,814 A * 10/1999 Schild, III et al. ..... 38/108
6,156,681 A * 12/2000 Tamaru et al. ..... 28/107

* cited by examiner

*Primary Examiner*—A Vanatta
(74) *Attorney, Agent, or Firm*—Michael Best & Friedrich LLC; Martin L. Stern

(57) ABSTRACT

A composite nonwoven fabric comprising multiple, layers of a web formed from a blended mixture of metal fibers and nonmetal fibers is provided. The metal fibers preferably have a rough outer surface with irregular shaped cross-sections that vary along their length. The fibers of adjacent layers of the web material are interengaged in a needlepunching step. The composite nonwoven fabrics of the invention, which have very good isotropic strength. In a preferred embodiment, the composite nonwoven fabric is employed as a floor buffing pad for use with an electric floor buffing apparatus.

30 Claims, 4 Drawing Sheets

COMPOSITE NONWOVEN FABRIC AND METHOD FOR MAKING SAME

FIELD OF THE INVENTION

This invention relates generally to nonwoven fabrics and relates more specifically to composite nonwoven fabrics that comprise a blend of metal fibers and nonmetal fibers. This invention also relates to methods for forming such composite nonwoven fabrics.

BACKGROUND OF THE INVENTION

It has long been known to use nonwoven textile fabrics for disposable diapers, fabric softener sheets, disposable medical garments, automotive trim fabric, and the like. Such nonwoven fabrics are commonly made of polymer fibers by various known processes. In general, the processes include a web forming step to organize the fibers into a web structure and a web bonding step to interconnect the fibers that comprise the web in an integrated structure.

The web forming step may entail a dry laid process, or a wet laid process. Known apparatus for dry laid processes include carding machines, garnetts and air laying machines. In commonly known wet laid processes, the fibers are suspended in a water based slurry and then caused to be laid down in a method resembling papermaking.

One method for web bonding is latex, resin, or foam bonding, in which an adhesive resin is impregnated into or sprayed onto the polymeric web to bond the fibers. Another method is thermal bonding which entails heating the surfaces of the polymeric fibers to fuse the fibers to one another. Optionally, the fibers may be laced with adhesive powder prior to fusing. A well-known mechanical bonding method is needlepunching, which uses barbed needles to punch vertically through the formed web causing the fibers to interengage and become entangled with one another. Another mechanical bonding method, known as stitchbonding, uses a continuous strand of fiber to sew a stitched pattern into a formed web.

The above-described processes and apparatus for making nonwoven fabrics are described in "The Non-Woven Fabric Handbook," by the Association of the Non-Woven Fabrics Industry. See also, Smith et al., U.S. Pat. No. 4,888,234, the contents of which are incorporated herein by reference.

Nonwoven fabrics comprised of metal fibers are also known. For example, Webber, U.S. Pat. No. Re. 28,470 discloses a nonwoven metal fabric comprising staple length metal fibers. The metal fibers are produced by bundle drawing, in a method similar to drawing wire. The metal fibers are then cut into appropriate lengths, and formed into a web. The metal web material is layered or laminated and compacted and/or annealed to form. a porous web structure.

Nonwoven metal fabrics are useful in various industrial, chemical and biological filtration processes. Another important application for nonwoven metal fabrics is as abrasive polishing pads which may be used in "sanding" or finishing wood products, removing rust from metallic surfaces, or buffing and polishing floors.

Nonwoven metal fabrics, for example, are particularly well suited for use as buffing pads for use with electric rotary floor buffing machines. Steel wool buffing pads have been known in the art for some time, and have advantages over grit based polishing pads such as those comprising a synthetic nonwoven fabric sprayed with an abrasive coating containing a desired amount of grit. Such grit based polishing pads polish surfaces by forming tiny scratches in the surface being polished. Steel wool buffing pads on the other hand, tend only to remove surface imperfections and bumps protruding above the surface being polished without actually scratching into the surface. Therefore, steel wool buffing pads tend not to wear the surface nearly as much as grit based pads. However, while steel wool buffing pads exhibit superior polishing qualities, they tend to wear out more quickly than their synthetic grit based counterparts. In order to strengthen steel wool polishing pads, pads have been formed from needle punched steel wool fabric.

Given the shortcomings of existing nonwoven metal fabrics, it is desirable it provide an improved nonwoven fabric that combines the advantages of steel wool or other metal fibers with the advantages of nonwoven fabrics formed of synthetic or other non-metal fibers. Such an improved nonwoven fabric should advantageously provide improved isotropic strength and greater durability, so that the improved fabric will be well suited for use as an abrasive in commercial sanding machines, and floor buffing machines, as well as other applications where it is useful to combine the advantages of metal and non-metal fibers.

SUMMARY OF THE INVENTION

It has been discovered that extremely strong nonwoven fabrics may be provided that comprise layers of a composite web material of metal and nonmetal fibers formed into an integrated matrix structure. The metal fibers preferably have rough outer surfaces that are irregular in cross-section with barbed projections. The nonmetal fibers are preferably crimped synthetic fibers. The intertwined mix of metal and nonmetal fibers comprising the nonwoven fabrics of the present invention provides surprising isotropic strength and structural integrity to the fabrics, providing improved performance features not heretofore achievable in single component nonwoven fabrics.

The composite nonwoven fabrics of the present invention comprise metal fibers having an average cross-sectional diameter of from about 25 microns to 125 microns or more, and preferably have an average diameter of 50 microns or more. Fibers greater than 50 microns in diameter are stronger, and do not break as easily as smaller fibers. Thus, the use of metal fibers having an average diameter greater than about 50 microns strengthens the composite nonwoven fabrics of the present invention. The barbs and irregular surfaces of the metal fibers provide the composite nonwoven fabric a desired abrasive quality, and helps maintain the interentanglement of the fibers. The abrasiveness, however, tends to be tempered by the commingling of the smoother and softer nonmetal fibers. Therefore, the strength and abrasiveness of the fabric can be controlled by careful manipulation of the mix of metal and non-metal fibers. Variables that can be controlled include the size of the fibers and the weight ratios between the metal and nonmetal fibers used in the product.

In a preferred embodiment the composite matrix fabric of the present invention forms an improved floor buffing pad. The nonmetal fibers comprise plastic strands of polyester, polypropylene or other suitable plastic material or other nonmetallic fibers, like cotton. As noted above, the composition of the composite matrix may be varied in order to maximize certain characteristics such as strength, durability or abrasiveness. The weight ratio between metal and nonmetal fibers may vary anywhere from as great as 20 parts metal fibers to one part nonmetal fibers and more, to as little as 5-parts metal fibers to one part non-metal fibers or less.

In the preferred embodiment of a floor buffing pad, the preferred weight ratio between metal and nonmetal fibers is in the range between 9–10 parts metal fiber to one part non-metal fibers. Given the densities of typical metal fibers such as steel wool, and non-metal fibers such as polyester, this corresponds to a near one-to-one fiber-to-fiber ratio. Preferably, the length of the fibers will be in the range between 1–6 inches long with 3 inch fibers preferred. The cross sectional diameter of the fibers is best between 25 to 125 microns with 50 microns preferred. This mix of metal and nonmetal fibers provides a fabric having isotropic strength and abrasiveness particularly well suited for use in floor buffing. Individual circular floor pads may be stamped, or die cut from large sheets of raw composite fabric.

DESCRIPTION OF THE DRAWINGS

FIG. 1(*b*) is a diagrammatic view showing the path of the blended fiber mixture through a series of apparatuses which in combination form a composite web structure comprising metal fibers and nonmetal fibers and then laps the composite web structure into a multi-layered composite web structure;

FIG. 1(*c*) is a diagrammatic view depicting needle-punching of the multi-layered composite web to form the composite nonwoven fabric of the invention;

FIG. 1(*d*) is a diagrammatic view showing a heated pinch roller apparatus that optionally may be used to heat fuse the fibers of the composite nonwoven fabric of the invention;

DETAILED DESCRIPTION OF THE INVENTION

Figure 1A:
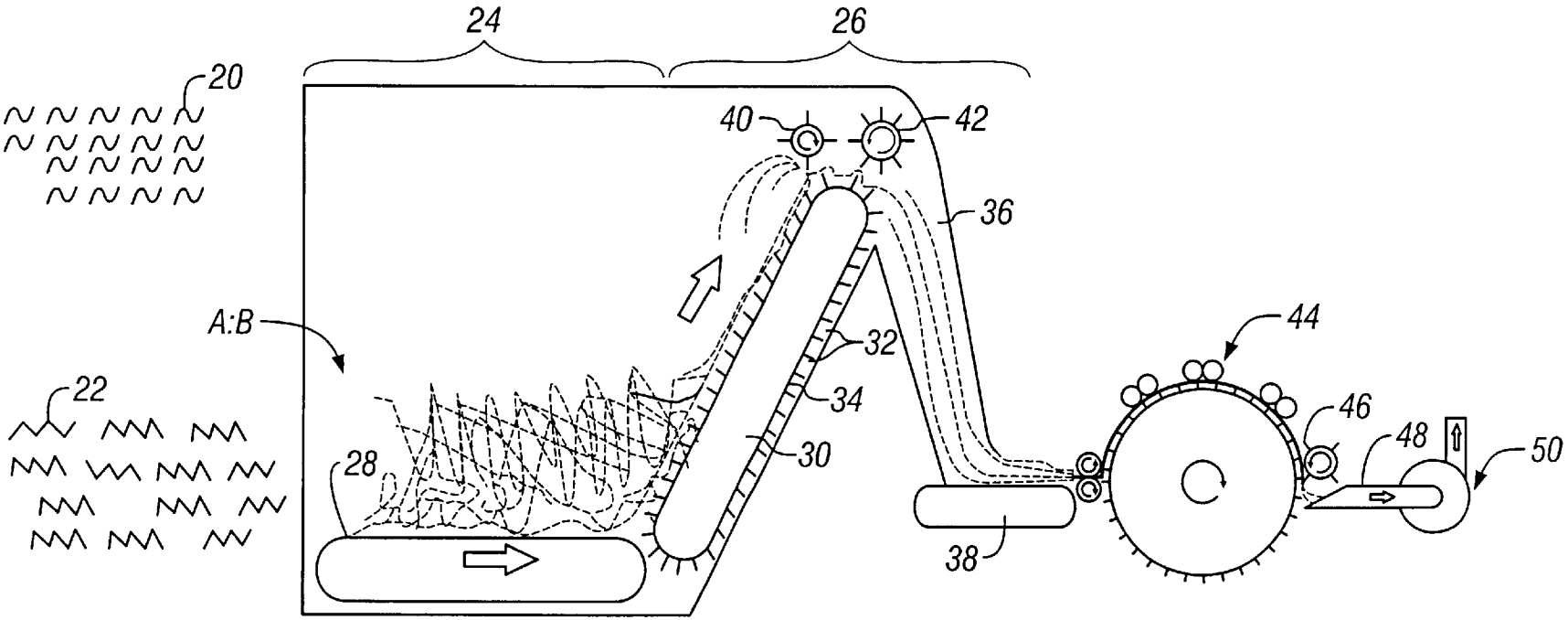
FIG. 1(*a*) is a diagrammatic view showing a combination of apparatus for dispersing quantities of metal fibers and nonmetal fibers to form a blended fiber mixture.
Figure 1B:
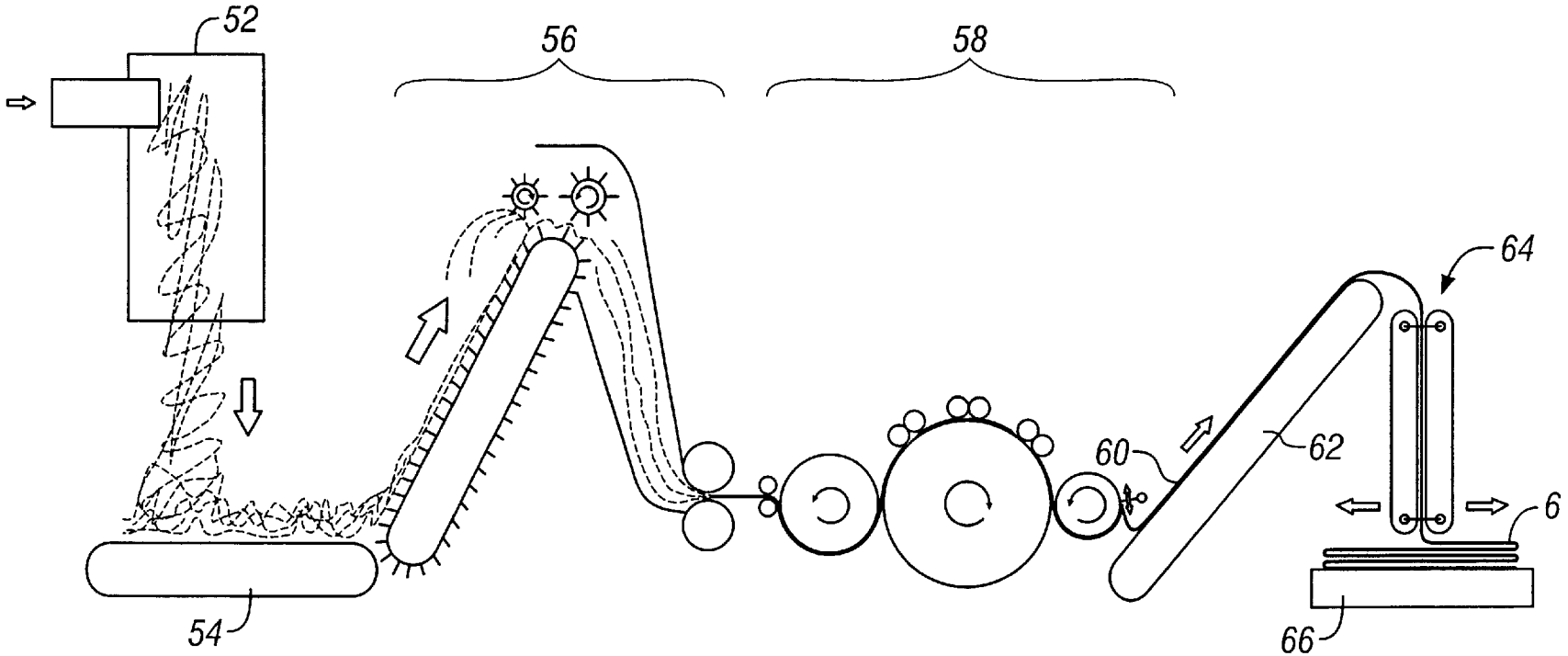
Figure 1C:
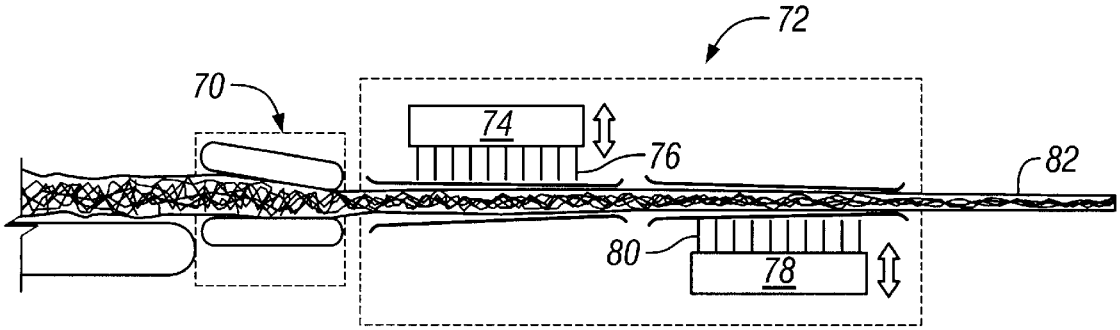
Figure 1D:
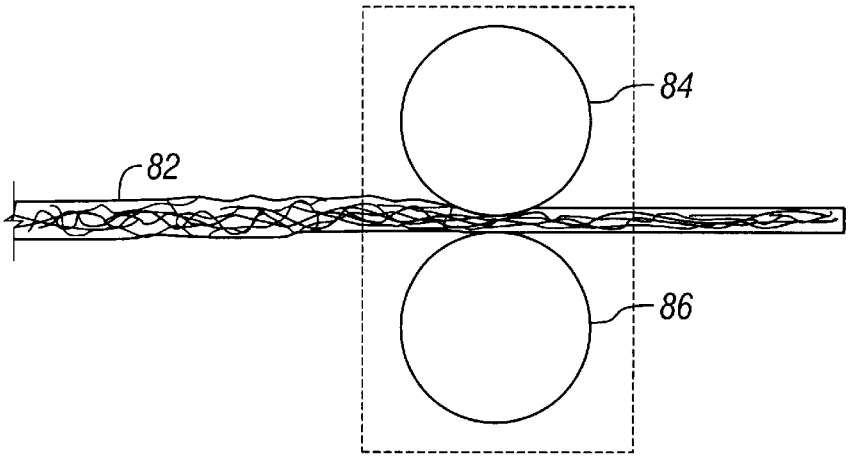

In one of its aspects, the present invention relates to a composite nonwoven fabric comprising a composite web material which includes metal fibers and nonmetal fibers intermixed and interengaged with one another. As used herein, the term composite nonwoven fabric means a non-woven fabric that comprises at least one type of metal fibers and at least one type of nonmetal fibers. The composite web material preferably may be made using a carding machine, a garnett, or may be run on an airlay system. The composite nonwoven fabric of the invention preferably then is lapped to form a multi-layered product with the fibers of adjacent layers being oriented in different directions. The fibers of the lapped layers are then interengaged with one another (in the z-direction) in a needle-punching step.

In another of its aspects, the present invention entails a method for making a composite nonwoven fabric, comprising the steps of: blending a predetermined amount of metal fibers and a predetermined amount of nonmetal fibers to provide a blend of metal and nonmetal fibers; carding the blended fibers to form a composite fiber web having the metal fibers and nonmetal fibers distributed throughout; and needle-punching the web to interengage fibers in adjacent layers to provide the composite nonwoven fabric. A presently preferred embodiment of the inventive method further includes the step of lapping the composite fiber web to form a multi-layered web prior to needle-punching step.

The metal fibers are preferably produced by shaving a metal member with a succession of serrated blades. A suitable lubricant, such as oil, is preferably applied to the metal member as it is being shaved by the blades in sufficient quantity so that the metal fibers retain on their outer surface a carding-effective amount of the oil or lubricant. By "carding-effective amount" of oil or lubricant it is meant that the metal fibers, when blended with the nonmetal fibers, can be carded without substantial breakage or disintegration. The lubricant optionally may be applied after the metal fibers are formed and before the carding step. Applicants co-pending application, U.S. Ser. No. 08/606,060, which is hereby incorporated by reference, discloses a process for shaving a metal bar to produce lubricated metal fibers and the use of such lubricated metal fibers in methods for making nonwoven metal fabric. A carding-effective amount of oil generally may be in the range of about 0.3 to 1.0 wt.% oil, more preferably about 0.4 to 0.7 wt.%, based on the total weight of the metal fibers, although lesser or greater amounts may be used depending on the type and average diameter of the metal fibers and the amount and type of nonmetal fibers included in the blended fiber mixture. For example, as the weight percentage of nonmetal fibers relative to the metal fibers is decreased, the quantity of oil or lubricant necessary to provide a carding effective amount may tend to increase. Conversely, as the weight percentage of nonmetal fibers relative to metal fibers increases, the nonmetal fibers may act as a "carrier" for the metal fibers in the carding step, reducing the quantity of oil needed for carding without breakage of the metal fibers. Thus, a carding-effective amount of oil for carding various combinations and amounts of metal and nonmetal fibers can be readily determined on a case-by-case basis.

Figure 3:
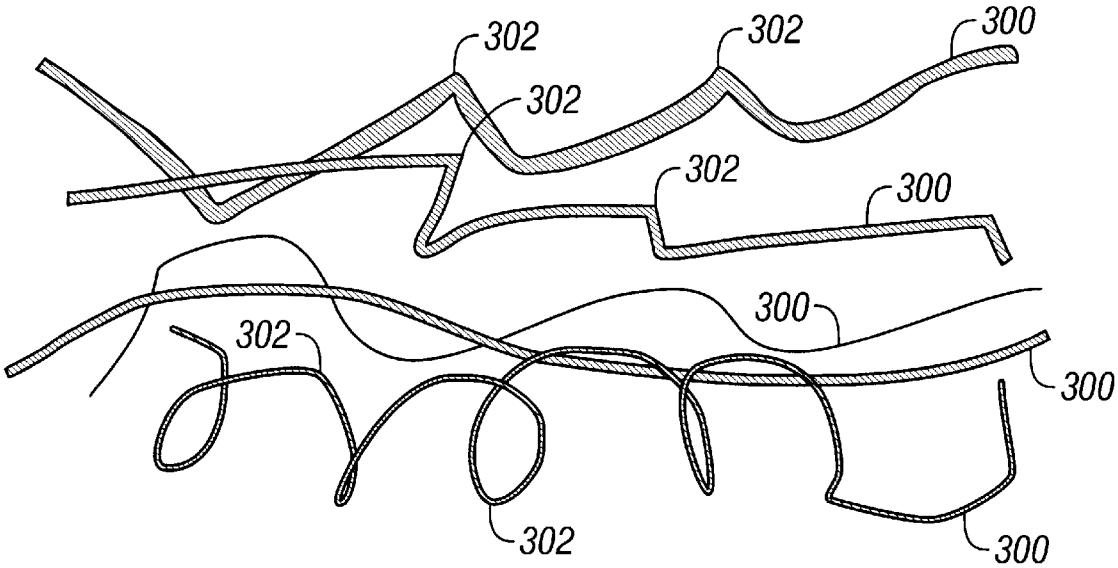
FIG. 3 depicts a magnified perspective view of the metal fibers of the composite nonwoven fabric of the invention.

A plurality of metal fibers 300 for use in the composite non-woven fabric of the present invention are shown in FIG. 3. By using a succession of serrated blades with a variety of serration patterns thereon, the metal fibers 300 are provided with irregular cross-sections and rough outer surfaces with barbs 302 formed thereon as depicted in FIG. 3. The irregular crosssections vary continuously along the length of the resulting fibers to provide generally curled metal fibers. The curled and barbed nature of the metal fibers allows strong interengagement with each other and with the non-metal fibers of the composite nonwoven fabric.

Preferably the metal fibers will have an average cross-sectional diameter of between about 25 and 125 microns. Presently preferred metals include stainless steel, carbon steel such as AISI 1006, copper, brass and other metals and metal alloys that can be shaved into suitable fibers. The metal fibers are cut into staple lengths using a suitable metal fiber cutting apparatus, such as a rotating knife, to provide metal fibers having a predetermined length ranging between about 1 inch to about 12 inches, more preferably less than about 6 inches. In a presently preferred embodiment, the metal fibers may have a length of about 6 inches prior to carding. Despite the presence of a carding effective amount of oil applied to the metal fibers, a certain amount of fiber breakage occurs during the carding process nevertheless. The result is a post carding web having metal fibers of approximately 1 to 3 inches long.

Figure 2:
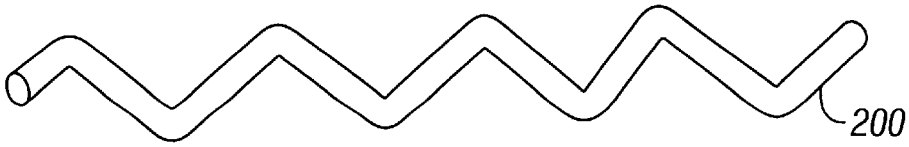
FIG. 2 depicts a magnified perspective view of a crimped nonmetal fiber useful in providing the composite nonwoven fabric of the invention.

A nonmetal fiber 400 of the of the type used in forming the composite nonwoven fabric of the present invention, is shown in FIG. 2. Such fibers may be essentially any synthetic or natural staple fibers conventionally used in the textile industry for making nonwoven fabric material, such as polypropylene, polyester, polyethylene, rayon, nylon, acetate, acrylic, cotton, wool, olefin, amide, polyamide, fiberglass and the like. The lengths of the nonmetal fibers may be from about 1 inch to about 12 inches, and are more preferably less than about 6 inches in length. It is presently preferred to use nonmetal fibers having length from about 1 to 3 inches. The nonmetal fibers may be cut to size by conventional means. The nonmetal fibers are less brittle than the metal fibers, and are generally unaffected by the carding process. The grade of the nonmetal fibers may range from about 1 denier to about 120 denier, more preferably from about 10 to 80 denier and most preferably about 18 to 60 denier. In general, the metal fibers will have an average cross-sectional diameter that is from ½ to 2-times the cross-sectional diameter of the nonmetal fibers. More preferably, the metal fibers and nonmetal fibers will have similar average diameters and lengths. A presently preferred composite nonwoven fabric comprises synthetic polymer fibers, such as polyester or polypropylene fibers, having a grade of about 60 denier and metal fibers having an average cross section of about 60 microns.

Crimped synthetic fibers having a repeating "V" shape along their length such as that shown in FIG. 2, are known in the art. Crimped synthetic fibers having about 3 to 10 "V" shaped crimps per inch are preferred as the nonmetal fibers in the composite nonwoven fabrics of the present invention, with crimped fibers having about 7 crimps per inch being the most preferred. Of course, a greater or lesser degree of crimping may be selected as the particular application demands. Such crimped synthetic fibers are generally employed because they are readily carded by a garnett or carding machine.

It is preferred that the composite nonwoven fabric of the present invention has a ratio of metal fibers to non-metal fibers of between about 10:1 and about 1:99, by weight. In one presently preferred embodiment of the present invention, the composite nonwoven fabric comprises about 75 to 95 wt.% metal fibers and about 5 to 25 wt.% nonmetal fibers, more preferably about 85 to 92 wt.% metal fibers and about 8 to 15 wt.% nonmetal fibers. Such composite nonwoven fabrics having up to 90 wt.% metal fibers are presently preferred for use as floor buffing pads.

As will be appreciated by those skilled in the art, metal fibers are several fold denser than nonmetal fibers—that is the specific gravity of metal fibers is substantially greater than the specific gravity of synthetic fibers and other nonmetal fibers. Accordingly, it will be understood that composite nonwoven fabric may have relatively similar numbers of metal fibers and nonmetal fibers, even though, on a weight percent basis, the composite nonwoven fabric is mostly metal.

It will also be appreciated by the person having ordinary skill in the art that "denier" is a measure of specific weight (or fineness) of a fiber which is arrived at by weighing a predetermined length of the fiber. (One denier equals 0.05 grams per 450 meters). Accordingly, different nonmetal fabrics having the same denier may have different cross-sectional diameters.

In the method of the present invention, staple length metal fibers and nonmetal fibers are blended prior to the carding step to obtain a substantially homogeneous mixture of the fibers. Blending of staple fibers may be accomplished by various mechanical means. In a basic example, two or more types of fibers may be mixed in an apparatus that is commonly known as a feedbox or blender and then fed directly into a carding apparatus. More preferably, a tandem feedbox arrangement may be used—that is an apparatus comprising two feedboxes in series—with the fibers being fed from the second feedbox directly into a carding apparatus. In a presently preferred embodiment of the invention, the blending step may be performed by a series of apparatuses including a single feedbox, a precard machine to open up both the metal and nonmetal fibers and blend them, and a stock fan blower. Other, more elaborate blending lines are well-known to those having ordinary skill in the art. Any of these foregoing blending methods are suitable for use in accordance with the present invention, depending on the degree of homogeneity desired for the composite nonwoven fabric of the invention.

Turning to FIGS. 1(*a*)–(*c*), a preferred arrangement of various textile devices will now be described in connection with a preferred embodiment of the method of the invention. A predetermined weight of staple length, shaved stainless steel fibers 20 (60 micron average diameter, 0.6% oil by weight) and staple length polyester; fibers 22 (60 denier, 7 crimps per inch) are introduced into the hopper 24 of feedbox 26 in a ratio of about 91 wt.% metal fibers (including oil) to 9 wt.% nonmetal fibers. The hopper has a hopper conveyor 28 that conveys the fibers to incline conveyor 30 having tines 32 extending from the conveyor belt 34 so as to engage and carrying randomly oriented fibers 20, 22 up the incline conveyor 30. The feedbox 26 has a first spiked roller 40 which is spaced apart from incline conveyor 30 by a predetermined amount and rotates counter to the direction of travel of the incline conveyor 30. Incline conveyor 30 and first spiked roller 40 comb the material to allow only a certain small amount of generally parallel fibers in a loose unstructured web to pass into chute 36. A second spiked roller 42 rotating in the direction of travel of the conveyor assists in removing the thin layer of fibers 20, 22 from the tines 32 of the conveyor. The combing action of the first spiked roller 40 removes excess fibers which are "recycled," or knocked back into the feedbox for further blending, resulting in a satisfactory distribution of metal and non-metal fibers.

The individual fibers 20, 22 that pass under first spike roller 40 drop through chute 36 and onto precard conveyor 38 are then advanced through to precard apparatus 44 to form an open precard web 46 of loosely entwined fibers. As precard web 46 exits the precard apparatus, it is sucked into the intake 48 of the stock blower fan 50 and is blown into condenser box 52 causing the fibers 20, 22 of precard web 46 to be randomized. The fibers 20, 22 then exit the condenser box and are fed by second feedbox conveyor 54 into a second feedbox 56 (substantially identical to feedbox 26) which further mixes/blends fibers 20, 22.

The blend of fibers 20, 22 is fed from second feedbox 56 into a shaker chute , then into the garnett 58 and is formed into a composite web 60. Composite web 60 is transported to the incline conveyor 62 into lapping apparatus 64 where composite web 60 is lapped to form a multi-layered structure 68. The lapping apparatus feeds the web 64 downwardly onto apron 66 while simultaneously moving the web from side to side in an oscillating motion (as depicted by the arrows) to cause the web material to invert and fold-over upon itself each time the oscillating lapper changes direction. While the lapping apparatus 64 deposits successive layers of the composite web 60 on top of each other, apron 66 advances slowly in a direction perpendicular the axis of oscillation so that the web 64 is laid down in a Z-shaped pattern as the fabric inverts and folds back upon itself. In this manner, a continuous-length of a multilayered composite web structure 68 is formed. As will be appreciated by those having ordinary skill in the art, the lapping step causes adjacent layers of web 64 to be laid on top of each other at a preselected angle. Because the fibers in each layer are relatively aligned, the direction of the fibers in adjacent layers of the composite web run on the bias with respect to one another. As will be appreciated, the number of layers in the multi-layered structure 68 as well as the degree of the bias between adjacent layers will be a function of the following variables: (i) the speed at which the composite web 60 is advanced through the lapping apparatus 64; (ii) the frequency of oscillation of the lapping apparatus 64; (iii) the width of the composite web 60; and (iv) the apron speed. In the preferred embodiment the composite web 60 is advanced on the lapping apparatus 64 at a speed of 47 feet per minute, and the lapping machine is oscillated at between 2–10 oscillations per minute. The preferred width of the composite web is between 20 to 60 inches and the apron speed is set between 5 to 50 feet per minute. However, the material can be manufactured on larger textile equipment that can produce widths of material up to 200 inches.

The multi-layered web structure 68 is then fed through a compression apron 70 (FIG. 1*c*) to slightly compress the multi-layered structure 68, and needled by a needle-punch apparatus 72 to form a composite nonwoven fabric of the invention. The needle-punch apparatus comprises a first punch board 74 having a first set of barbed needles 76. First punch board 74 reciprocates up and down and punches the multi-layered composite web from the top side to interengage fibers on the down-stroke. The needle-punch 72 further comprises a second punch board 78 having a second set of barbed needles 80. Second punch board 78 reciprocates up and down and punches the multi-layered composite web from the underside to interengage fibers on the upstroke.

Figure 4:
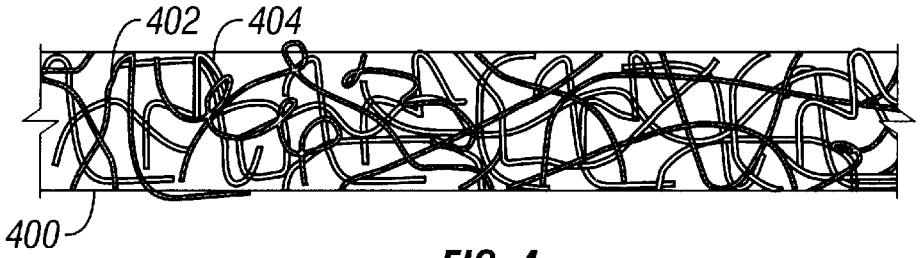
FIG. 4 is a magnified sectional view of the composite nonwoven fabric of the invention showing the random arrangement of the metal and nonmetal fibers.

Turning to FIG. 4, the needle punched composite nonwoven fabric is shown at 400.The needling of the multi-layered structure interengages the fibers of respective layers, giving the resulting composite fabric improved strength and fiber density. The needling process causes the metal 402 and nonmetal 404 fibers to be interengaged in and between the layers (in the "z" direction relative to the layers). Because the fibers of the composite nonwoven fabric are interengaged in the x and y axes during the carding step, the resulting, needle-punched fabric has the fibers interengaged in the x, y, and z directions to form an isotropically strong, coherent composite structure having desirable properties.

A composite nonwoven fabric comprising synthetic polymer fibers optionally may be subjected to a heat-fusing step to fuse at least a portion of the fibers at their intersections. A heat-fusing step may be carried out (i.e., after the needle-punching step) by heating the composite nonwoven fabric to a predetermined temperature that is at least equal to the melting point of the synthetic fibers, preferably to a temperature from about 10 to 50° C. or more above the melting point of the synthetic fibers. Heat is conducted to the composite nonwoven fabric for an amount of time (e.g., 1 to about 20 seconds or more) sufficient to cause the outer surface of the synthetic fibers to at least partially melt so that upon cooling the synthetic fibers fuse to other fibers with which they are in contact. With reference to FIG. 1(*d*), in an embodiment the heating step may be carried out by passing the composite nonwoven fabric through a pinch roll apparatus comprising a heat-conductive roll 84 and a resilient (e.g., rubber) roll 86, with the clearance between the pinch rolls set to at least partially compress the composite nonwoven fabric while it is in contact with the heated pinch roll. The amount of time the composite nonwoven fabric spends in contact with the heated roll may be adjusted depending on the amount of melting of the synthetic fibers desired. It is presently preferred that the fabric contact the heated roll between 3 and 10 seconds. Other methods of heating and melting the synthetic fibers include compressed hot air and direct radiant heating or a calendering machine. As will be appreciated, the amount of fusion between the fibers will be greatest at the surface contacting the heated roller. Optionally, two or more such pinch roll devices may be used in series so that both surfaces of the composite nonwoven fabric are brought into direct contact with a heat conductive roll 84 to fuse the fibers of the composite nonwoven fabric.

Figure 5:
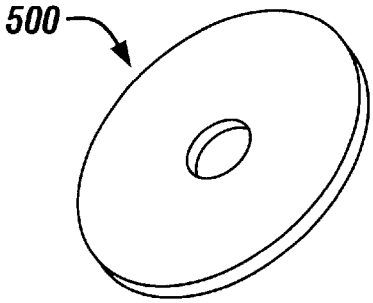
FIG. 5 is a perspective view of a floor polishing pad comprising a composite nonwoven fabric according to the present invention.

Turning to FIG. 5, a floor buffing pad is shown at 500. Pad 500 comprises a circular disc formed of a composite matrix nonwoven fabric as described above. In the preferred embodiment, the buffing pad has a diameter of 17 inches or any other diameter, and is approximately ½inches inch thick. The pad 500 may be operatively mounted to the rotating surface of an electric floor buffer such that the pad is rapidly whisked across the floor to shine and polish the surface of the floor. The nonmetal fibers- of the composite matrix comprise polyester fibers and the metal fibers comprise mild steel. The fiber-to-fiber ratio between the metal to nonmetal fibers is approximately one-to-one, Which corresponds, however, to a weight ratio of approximately ten-to-one between steel fibers and synthetic fibers. Preferably, the metal fibers will be in the range between 1–6 inches long, and will have a cross sectional diameter of between 25 to 125 microns with 50–75 microns diameter fibers preferred. In addition to having the proper abrasiveness for polishing floors, a composite matrix floor buffing pad having this mix of metal and nonmetal fibers provides significant isotropic strength which leads to a longer lasting steel wool buffing pad. Individual circular floor pads may be stamped, or die cut from large sheets of raw composite fabric. If desired, the composite matrix may be compressed prior to or during die cutting, or the non-metal fibers may be melted to further enhance the isotropic strength of the floor buffing pad.

While the present invention has been described with reference to preferred embodiments thereof, as illustrated in the accompanying drawings, various changes and modification can be made by those skilled in the art without departing from the spirit and scope of the present invention; therefore, the appended claims are to be construed to cover equivalent structures.

We claim:

1. A method for making a composite nonwoven fabric, comprising:

(a) blending a first amount of metal fibers and a second amount of nonmetal fibers to provide a blend of metal and nonmetal fibers;

(b) forming a composite fiber web having the metal fibers and nonmetal fibers distributed throughout; by one of carding, garnetting, and airlaying the blend of metal and nonmetal fibers (c) needle-punching the web to interengage fibers in adjacent layers to provide the composite nonwoven fabric.

2. A method according to claim 1, further comprising the step of: (d) lapping the composite fiber web to form a multi-layered web prior to step (c).

3. A method according to claim 2, wherein the metal fibers have a rough outer surface with irregular shaped cross-sections that vary along their length.

4. A method according to claim 3, wherein the metal fibers are coated with a carding-effective amount of lubricant.

5. A method according to claim 2, wherein the composite nonwoven fabric comprises from about 75 to 95 wt.% metal fibers and from about 5 to 25 wt. % nonmetal fibers.

6. A method according to claim 2, wherein the average diameter of the metal fibers is between about 40 and 80 microns.

7. A method according to claim 2, wherein the nonmetal fibers are crimped synthetic fibers of a grade between about 2 denier and 80 denier.

8. A method according to claim 2 wherein the metal fibers have an average diameter that is not more than twice the diameter of the nonmetal fibers.

9. A method according to claim 8, wherein the average diameter of the metal fibers is approximately equal to the average diameter of the nonmetal fibers.

10. A method according to claim 9, wherein the metal fibers and the nonmetal fibers have an average length of from about 1 to 6 inches.

11. A method according to claim 2, wherein the metal fibers are composed of a metal selected from the group consisting of carbon steel, stainless steel, copper, brass, aluminum and nickel.

12. A method according to claim 7, wherein the metal fibers have an average diameter of about 60 microns and the nonmetal fibers have a grade of about 60 denier.

13. A method according to claim 12 wherein the metal fibers further comprise an irregular barbed outer surface.

14. A method according to claim 12, wherein the nonmetal fibers are crimped staple fibers selected from the group consisting of polyester fibers and polypropylene or low melting polyethylene.

15. A method for making a composite nonwoven fabric, comprising the steps of:

(a) blending a mixture of metal fibers and nonmetal fibers to form a layer of fibers;

(b) overlaying at least two layers of fibers to form a multi-layered structure; and (c) needle-punching the multi-layered structure to interengage the metal and nonmetal fibers to form a single homogenous web.

16. The method of claim 15, wherein the metal fibers and nonmetal fibers are blended by one of carding, garnetting and airlaying the mixture of metal fibers and nonmetal fibers.

17. The method of claim 15, wherein the multi-layered structure is formed by lapping a single layer of fibers.

18. The method of claim 15, wherein the metal fibers have a rough outer surface with irregular shaped cross-sections that vary along their length.

19. The method of claim 18, wherein the average diameter of the metal fibers is between about 40 to 80 microns.

20. The method of claim 18, wherein the metal fibers are coated with a lubricant.

21. The method of claim 15, wherein the metal fibers are composed of a metal selected from the group consisting of steel, copper, brass, aluminum, nickel and combinations thereof.

22. The method of claim 15, wherein the nonmetal fibers are crimped.

23. The method of claim 15, wherein the nonmetal fibers are selected from the group consisting of polyester fibers, propylene fibers, low melting polyethylene fibers and combinations thereof.

24. The method of claim 15, wherein the average diameter of the metal fibers and nonmetal fibers is approximately equal.

25. The method of claim 15, wherein the average diameter of the metal fibers is not more than twice the average diameter of the nonmetal fibers.

26. The method of claim 15, wherein the average diameter of the metal fibers is between about 40 to 80 microns, and the average diameter of the nonmetal fibers is between about 2 to 80 denier.

27. The method of claim 15, wherein the average length of the metal fibers and nonmetal fibers is between about 1 to 6 inches.

28. The method of claim 15, wherein the mixture of metal fibers and nonmetal fibers comprises between about 75 to 95 wt % metal fibers and between about 5 to 25 wt % nonmetal fibers.

29. The method of claim 15, further comprising the step of forming the web of fibers into a disc.

30. The method of claim 29, wherein the disc has a diameter of about 17 inches and a thickness of between about ½ to 1 inch thick.

* * * * *